US007647870B2

(12) United States Patent
Pokryvailo et al.

(10) Patent No.: US 7,647,870 B2
(45) Date of Patent: Jan. 19, 2010

(54) ELECTROMAGNETIC LAUNCH SYSTEM

(75) Inventors: Alex Pokryvailo, Yavne (IL); Shlomo Wald, Yavne (IL)

(73) Assignee: Soreq NRC, Nahal Soreq, Yavne (IL)

( * ) Notice: Subject to any disclaimer, the term of this patent is extended or adjusted under 35 U.S.C. 154(b) by 503 days.

(21) Appl. No.: 11/505,422

(22) Filed: Aug. 17, 2006

(65) Prior Publication Data

US 2007/0040132 A1 Feb. 22, 2007

(51) Int. Cl.
*F42C 11/04* (2006.01)

(52) U.S. Cl. ..... 102/202.8; 102/220; 102/472; 102/202.9; 89/1.813; 89/27.13; 89/28.05

(58) Field of Classification Search ..... 102/220, 102/472, 202.7, 202.8, 202.9; 89/1.813, 89/1.814, 135, 27.13, 28.05
See application file for complete search history.

(56) References Cited

U.S. PATENT DOCUMENTS 4,207,796 A * 6/1980 Warnock ..... 89/28.05
5,261,315 A * 11/1993 Marinos ..... 102/202.7
5,568,019 A * 10/1996 Mason ..... 315/344

* cited by examiner

*Primary Examiner*—Stephen M Johnson
(74) *Attorney, Agent, or Firm*—Dekel Patent Ltd; David Klein

(57) ABSTRACT

An electromagnetic launch system including an electrothermal launcher, an inductive power supply (IPS), including a DC source ($V_b$) and a storage inductor (L), and an opening switch (OS), wherein at least a portion of at least one of the IPS and the OS is integrated in a projectile.

4 Claims, 3 Drawing Sheets

ELECTROMAGNETIC LAUNCH SYSTEM

FIELD OF THE INVENTION

This invention is related to projectile acceleration by means of electromagnetic launchers, especially electrothermal and electrothermal-chemical guns, energized by inductive energy storage systems.

BACKGROUND OF THE INVENTION

Many electromagnetic launch systems including electrothermal and electrothermal-chemical guns are known. The majority of them make use of capacitive-based pulsed forming networks (PFN) for launcher energizing. However, capacitive storage possesses low energy density, and hence system volume is unacceptably large for practical applications. Inductive storage systems possess much higher energy density, but their implementation is hampered by lack of compact, repetitive, inexpensive and robust opening switches.

An implementation of an opening switch in an inductive power supply known in the art is shown in FIG. 1 as described in Pokryvailo, A., Kanter, M. and Shaked, N., "Two-Stage Opening Switch for Inductive Energy Storage Systems", IEEE Trans. on Magnetics, Vol. 34, No. 3, pp. 655-663, May 1998. The primary power source, $V_b$, is a battery bank. The opening switch comprises a vacuum circuit breaker, employed as a closing switch and as the first stage of the opening switch, and a fuse serving as the second stage. An SCR (Silicon-Controlled Rectifier) in series with the fuse blocks the battery voltage during the coil charge, while diode D blocks the load; the latter can be an electromagnetic launcher.

Upon the vacuum breaker closing, the coil L is charged. The switching sequence begins with the breaker opening at time $t_0$, as shown in FIG. 2. When the voltage across its contacts exceeds the comparator reference voltage, the comparator fires the SCR. Driven by the arc voltage, the charge current passes to the fuse in the interval $t_0$-$t_1$. The fuse current, $i_f$, flows during interval $t_1$-$t_2$ to enable a sufficient separation d of the contacts, and thus the recovery of the vacuum breaker dielectric strength during the current zero pause. Upon the fuse blowing, the opening sequence is accomplished by the current transfer to the load, when the voltage is inductively generated across the switch and the load.

However, in this implementation, fuses must be assembled in a cassette to enable repetitive operation, increasing the system volume and cost.

SUMMARY OF THE INVENTION

The present invention seeks to provide novel, efficient, compact, simple and robust power supply systems for electromagnetic and/or electrothermal launch systems, as is described in detail further hereinbelow. In accordance with non-limiting embodiments of the invention, part of the pulsed-power supply or opening switch can be embodied as a consumable element of the launching system, e.g., the opening switch may be integrated in a projectile cartridge (also referred to as projectile or propelled object). In accordance with further non-limiting embodiments of the invention, a plasma generator device (PD) may produce plasma by a confined capillary discharge.

There is provided in accordance with an embodiment of the present invention an electromagnetic launch system including an electrothermal launcher, an inductive power supply (IPS), including a DC source ($V_b$) and a storage inductor (L), and an opening switch (OS), wherein at least a portion of at least one of the IPS and the OS is integrated in a projectile.

In accordance with an embodiment of the present invention the OS includes a multistage hybrid opening switch that has a plurality of stages, wherein one of the stages includes a consumable load element (CLE) incorporated into the projectile. The CLE may include a single-use, consumable PD located inside an ignition compartment (IC) of the projectile. The CLE may include a high-voltage fuse or a plasma flashboard, for example. The electrothermal launcher may be an electrothermal and/or an electrothermal-chemical gun.

Further in accordance with an embodiment of the present invention the CLE may include a confined-capillary-discharge plasma injector with a high-voltage fuse placed inside a capillary.

In accordance with an embodiment of the present invention the multistage hybrid opening switch includes three stages, wherein the last stage is connected in parallel to the first and second stages via a closing switch.

Further in accordance with an embodiment of the present invention the multistage hybrid opening switch may include three stages, a first stage including a mechanical switch (OS1), a second stage including an all-solid state controllable switch (OS2), and a third stage including a closing switch (CS) that separates a plasma device (PD) of the third stage from the second stage (OS2). The DC source may include a high-power battery.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
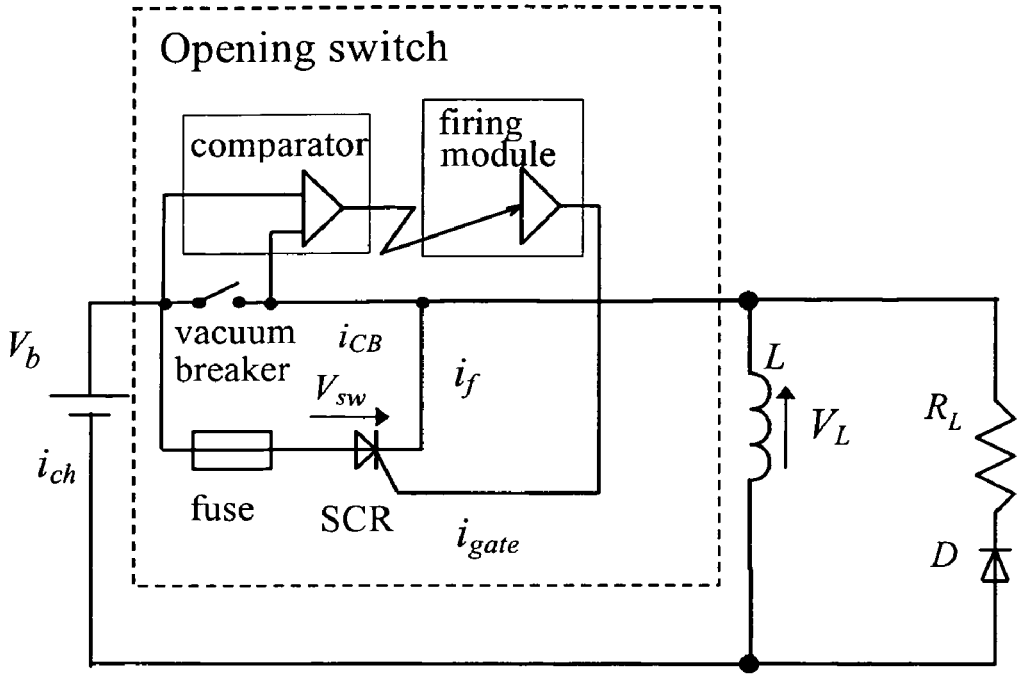
FIG. 1 PRIOR ART
FIG. 1 is a simplified schematic illustration of a prior art inductive power supply with a two-stage switch, useful in an electromagnetic launch system.
Figure 2:
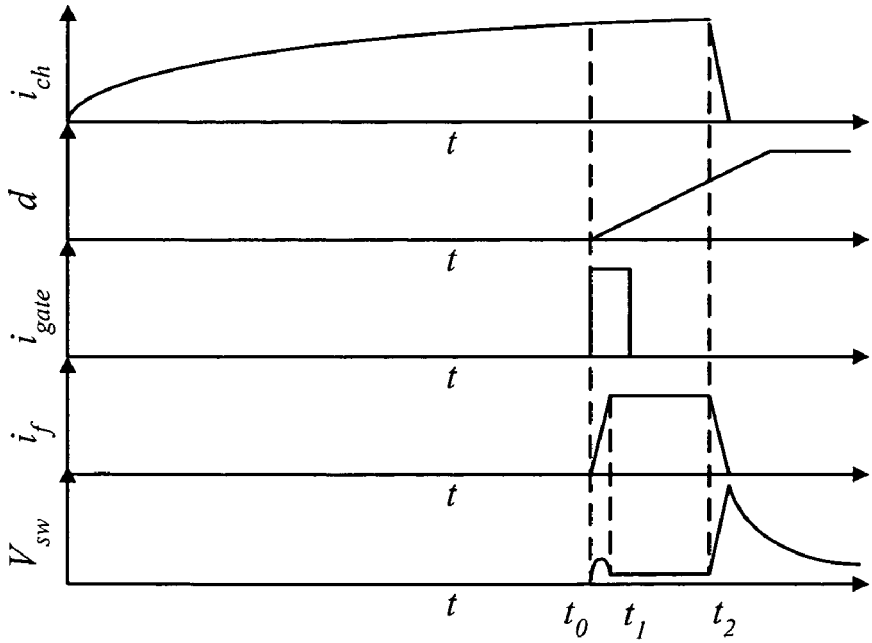
FIG. 2 PRIOR ART
FIG. 2 is a simplified experimental timing diagram of the prior art system of FIG. 1.
Figure 3:
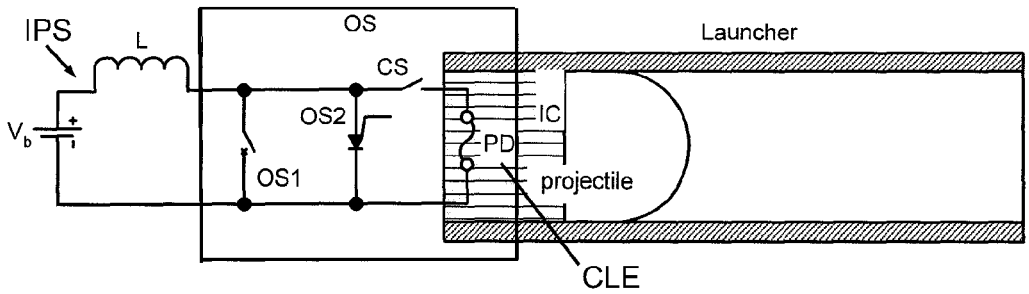
FIG. 3 is a simplified schematic illustration of a launch system with a three-stage opening switch, constructed and operative in accordance with an embodiment of the present invention.

Reference is now made to FIG. 3, which illustrates a launch system with a three-stage opening switch, constructed and operative in accordance with an embodiment of the present invention.

The non-limiting illustrated device includes an inductive power supply (IPS), which may include a DC source ($V_b$) and a storage inductor (L). The device may further include an opening switch (OS), an electrothermal launcher and a projectile. The OS may include three stages; the first being a mechanical switch (OS1), the second being an all-solid state controllable switch, whereas a closing switch (CS) separates a plasma device (PD) of the last stage from the previous stage (OS2). The single-use, consumable PD is located inside an ignition compartment (IC) of the projectile cartridge.

Figure 4:
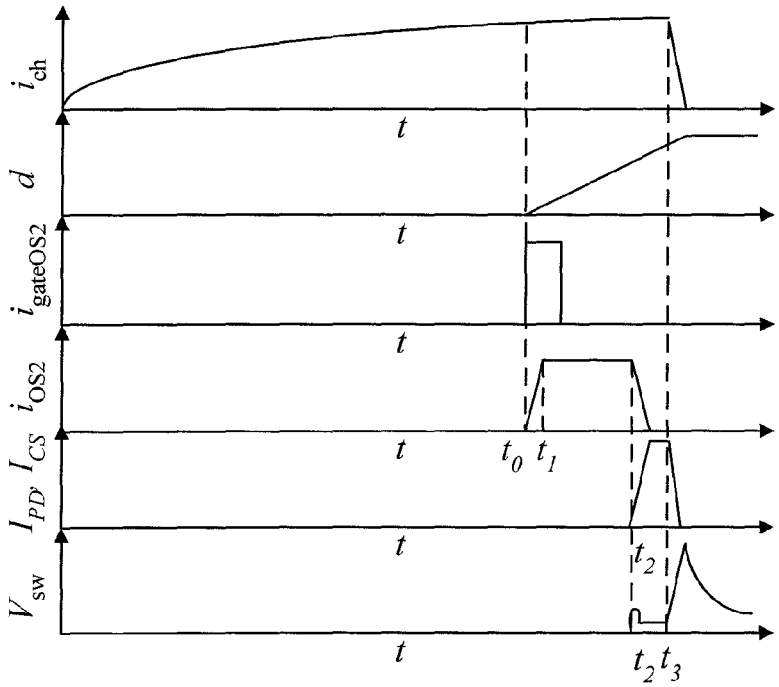
FIG. 4 is a simplified experimental timing diagram of the launch system of FIG. 3.

The launching system may operate as follows. In an initial state, all stages of the OS are opened. Upon closure of the switch OS1, the coil L is charged. The switching sequence begins with switch OS1 opening at time $t_0$, as shown in FIG. 4. Simultaneously with switch OS1 opening, switch OS2 is gated in the conducting state, and the charge current passes to switch OS2 in the interval $t_0$-$t_1$. The switch OS2 current flows during the interval $t_1$-$t_2$ to enable recovery of the current stored in coil L after opening switch OS1. At time $t_2$, switch OS2 is opened, switch CS is closed, and current flows via switch CS to the plasma device PD of the last stage of the switch OS. Upon PD opening, the opening sequence is accomplished by the current transfer to the load, when the voltage is inductively generated across the switch and the load. The electrical energy deposited in the ignition compartment IC accelerates the projectile and emits it from the launcher. PD can be a fuse, a flashboard, or any other plasma device known in art capable of current breaking. After the projectile has been replaced, the launch system is ready for the next round.

Figure 5:
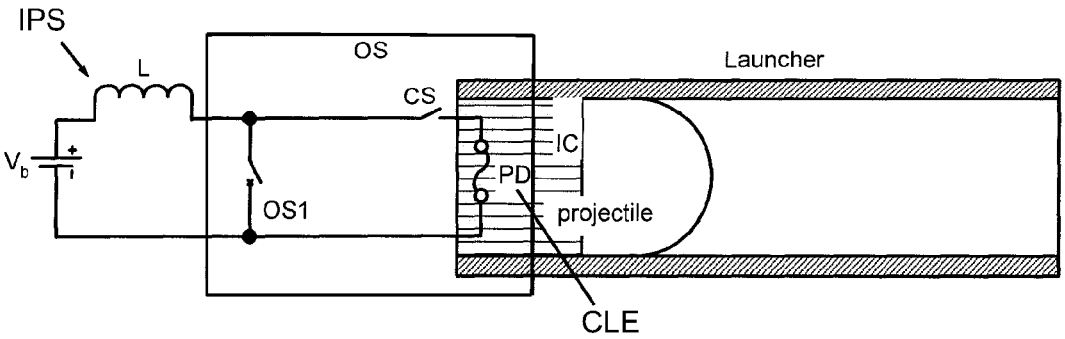
FIG. 5 is a simplified schematic illustration of a launch system with a two-stage opening switch, constructed and operative in accordance with another embodiment of the present invention.
Figure 6:
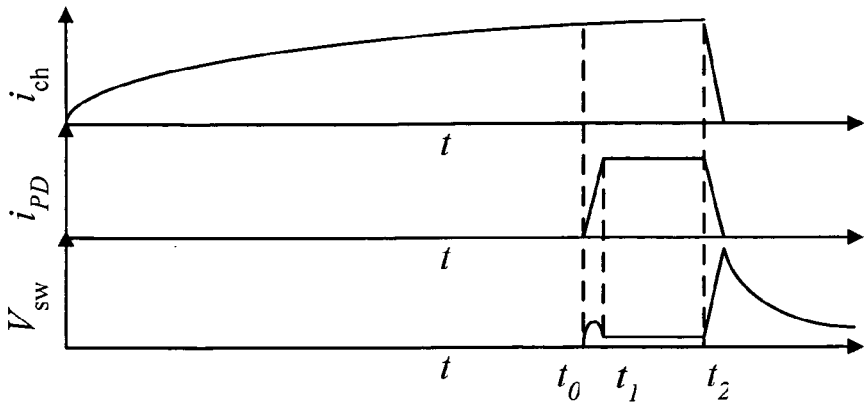
FIG. 6 is a simplified experimental timing diagram of the launch system of FIG. 5.

Another non-limiting embodiment of the invention is shown in FIG. 5. It essentially is the same as the embodiment of FIG. 3, except that the opening switch comprises only two stages, OS1 and PD. Its operation is described by timing diagrams FIG. 6. In the initial state, all stages of the switch OS are opened. Upon closure of switch OS1, the coil L is charged. The switching sequence begins with switch OS1 opening at time $t_0$, as shown in FIG. 6. Simultaneously with the switch OS1 opening, switch CS is switched on, and the charge current passes to the PD in the interval $t_0$-$t_1$. The PD current flows during interval $t_1$-$t_2$ to enable recovery of the current stored in coil L after opening switch OS1. At time $t_2$, PD opens, and the opening sequence is accomplished by the current transfer to the load, when the voltage is inductively generated across the switch and the load. The electrical energy deposited in the ignition compartment IC accelerates the projectile and emits it from the launcher. PD can be a fuse, a flashboard, or any other plasma device known in art capable of current breaking. After the projectile has been replaced, the launch system is ready for the next round.

Figure 7:
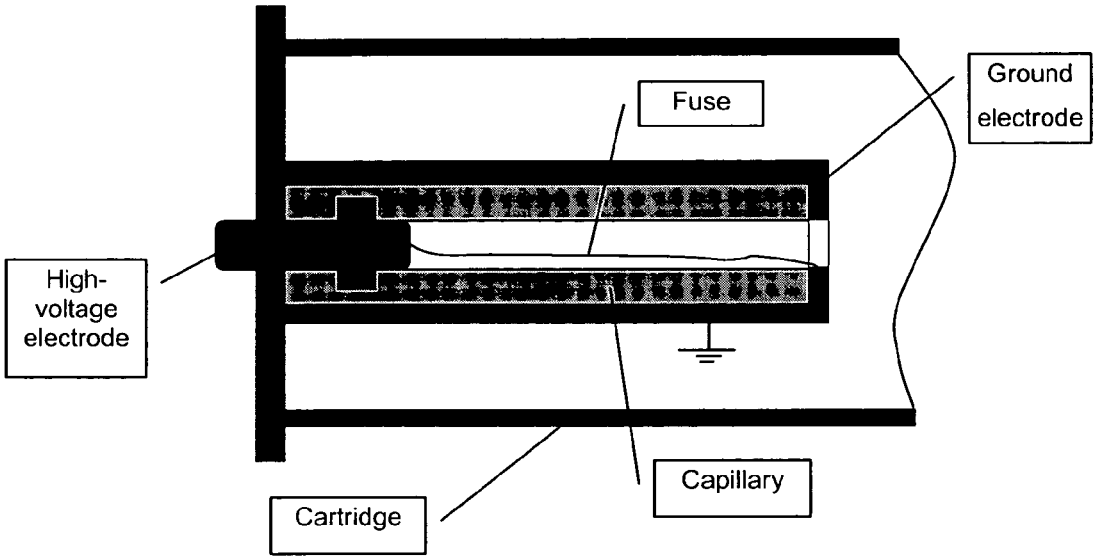
FIG. 7 is a simplified illustration of a launch system with a capillary plasma injector and a high-voltage fuse inside it, said fuse acting as the last stage of the opening switch, constructed and operative in accordance with another embodiment of the present invention.

Yet another non-limiting embodiment of the invention is shown in FIG. 7. The PD may be placed within a single-use cartridge filled with a working material (the propellant). Following the current transfer to the fuse, plasma is formed within the capillary. The plasma starts to ablate the dielectric capillary material causing the increase of the plasma density and the reduction of the plasma conductivity. Quasi-equilibrium is reached between the plasma formation and the plasma jet escaping from the nozzle within the cathode. The plasma jet ignites and controls the combustion of the working fluid within the cartridge. The plasma channel continues to conduct the current until complete discharge of the coil. After the cartridge has been replaced, the launch system is ready for the next round.

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. An electromagnetic launch system comprising:

an inductive power supply (IPS), comprising a DC source ($V_b$) a first terminal of which is connected to a first terminal of a storage inductor (L);

a switch (OS1), a first terminal of which is connected to a second terminal of said DC source ($V_b$), and a second terminal of which is connected to a second terminal of said storage inductor (L);

a consumable load element (CLE) connected in parallel to said switch (OS1), wherein a closing switch (CS) is connected between the second terminal of said switch (OS1) and one of the terminals of said consumable load element (CLE), wherein said consumable load element (CLE) is located inside an ignition compartment (IC) of a projectile cartridge and said projectile cartridge is located in a launcher;

wherein during closure of said switch OS1, said storage inductor L is charged, and when said switch OS1 is opened, said closing switch CS is simultaneously switched on, and current passes to said consumable load element (CLE), wherein the current that has passed to said consumable load element (CLE) located in said ignition compartment (IC) accelerates said projectile cartridge causing said projectile cartridge to be emitted from said launcher.

2. The electromagnetic launch system according to claim 1, wherein said consumable load element (CLE) comprises a single-use, consumable plasma generator device (PD).

3. The electromagnetic launch system according to claim 2, wherein said PD comprises a plasma flashboard.

4. The electromagnetic launch system according to claim 1, wherein said DC source comprises a high-power battery.

* * * * *